US010737503B2

(12) United States Patent
Hara et al.

(10) Patent No.: US 10,737,503 B2
(45) Date of Patent: Aug. 11, 2020

(54) FLUID CIRCULATION APPARATUS AND FLUID EJECTION APPARATUS

(71) Applicant: TOSHIBA TEC KABUSHIKI KAISHA, Tokyo (JP)

(72) Inventors: Kazuhiro Hara, Numazu Shizuoka (JP); Taiki Goto, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/104,768

(22) Filed: Aug. 17, 2018

(65) Prior Publication Data

US 2019/0092035 A1 Mar. 28, 2019

(30) Foreign Application Priority Data

Sep. 25, 2017 (JP) ..... 2017-183721

(51) Int. Cl.
*B41J 2/175* (2006.01)
*B41J 2/18* (2006.01)
*B41J 2/19* (2006.01)

(52) U.S. Cl.
CPC ..... *B41J 2/17566* (2013.01); *B41J 2/175* (2013.01); *B41J 2/17556* (2013.01); *B41J 2/17596* (2013.01); *B41J 2/18* (2013.01); *B41J 2/19* (2013.01)

(58) Field of Classification Search
CPC . B41J 2/175; B41J 2/18; B41J 2/17596; B41J 29/38; B41J 2/17513; B41J 2/17566; B41J 2202/12; B41J 29/393; B41J 2002/17576; B41J 2/17556; B41J 2/19
See application file for complete search history.

(56) References Cited

U.S. PATENT DOCUMENTS 7,669,990 B2 3/2010 Murakami et al.
2007/0291086 A1* 12/2007 Murakami ..... B41J 2/18 347/85
2010/0079562 A1 4/2010 Katada et al.
2013/0002772 A1* 1/2013 Hiratsuka ..... B41J 2/18 347/85
2016/0001570 A1 1/2016 Okayama
(Continued)

FOREIGN PATENT DOCUMENTS

EP 2977210 A1 1/2016
EP 3339039 A1 6/2018
(Continued)

OTHER PUBLICATIONS

Extended European Search Report dated Feb. 13, 2019, mailed in counterpart European Application No. 18193498.5, 9 pages.
U.S. Appl. No. 16/104,735, filed Aug. 17, 2018.

*Primary Examiner* — Jannelle M Lebron
(74) *Attorney, Agent, or Firm* — Kim & Stewart LLP

(57) ABSTRACT

According to one embodiment, a fluid circulation apparatus includes a first tank to store fluid to be supplied to a fluid ejection head, a circulation path including a first flow path portion to provide fluid from the first tank to a supply port of the fluid ejection head, and a second flow path portion to return fluid from a collection port of the fluid ejection head to the first tank, a bypass flow path that connects the supply port to the collection port outside of the fluid ejection head, and a buffer tank in the bypass flow path.

17 Claims, 11 Drawing Sheets

(56) References Cited

U.S. PATENT DOCUMENTS

| | | | | |
|---|---|---|---|---|
| 2016/0347080 | A1 | 12/2016 | Okayama | |
| 2017/0043589 | A1* | 2/2017 | Ratjen | B41J 2/18 |
| 2017/0197426 | A1 | 7/2017 | Nagai et al. | |
| 2018/0072069 | A1 | 3/2018 | Hara et al. | |
| 2018/0170066 | A1 | 6/2018 | Ohtsu et al. | |

FOREIGN PATENT DOCUMENTS

| | | | |
|---|---|---|---|
| JP | 2014-097619 | A | 5/2014 |
| JP | 2016-010786 | A | 1/2016 |
| JP | 2016-221817 | A | 12/2016 |

* cited by examiner

FLUID CIRCULATION APPARATUS AND FLUID EJECTION APPARATUS

CROSS-REFERENCE TO RELATED APPLICATION

This application is based upon and claims the benefit of priority from Japanese Patent Application No. 2017-183721, filed Sep. 25, 2017, the entire contents of which are incorporated herein by reference.

FIELD

Embodiments described herein relate generally to a fluid circulation apparatus and a fluid ejection apparatus.

BACKGROUND

A fluid circulation apparatus for circulating fluid through a fluid ejection head in a circulation path is known. The fluid ejection apparatus includes a tank having an air layer upstream of the fluid ejection head in the circulation path to alleviate fluctuations in the fluid pressure flowing into the fluid ejection head. Thus fluctuations in the fluid pressure of a nozzle are reduced.

DETAILED DESCRIPTION

In general, according to one embodiment, a fluid circulation apparatus includes a first tank to store fluid to be supplied to a fluid ejection head, a circulation path including a first flow path portion to provide fluid from the first tank to a supply port of the fluid ejection head, and a second flow path portion to return fluid from a collection port of the fluid ejection head to the first tank, a bypass flow path that connects the supply port to the collection port outside of the fluid ejection head, and a buffer tank in the bypass flow path.

First Embodiment

Figure 1:
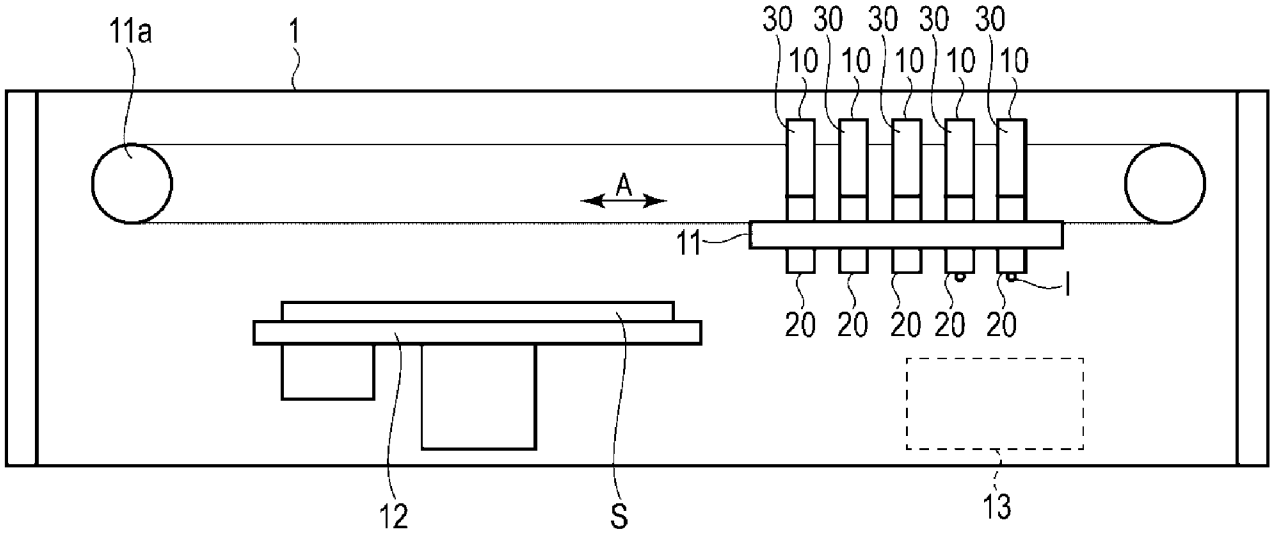
FIG. 1 is a side view of an inkjet recording apparatus according to a first embodiment.
Figure 2:
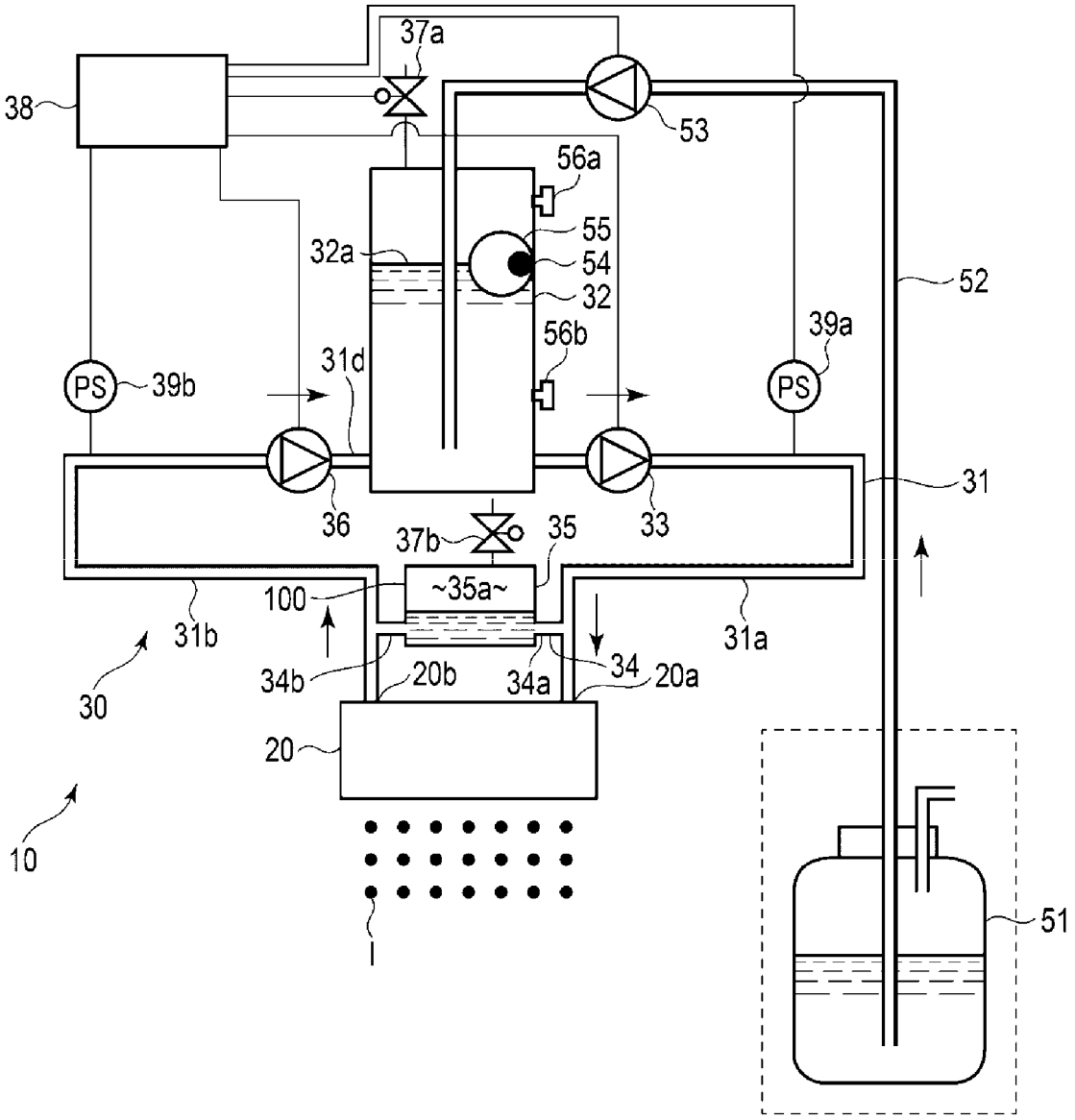
FIG. 2 is an explanatory view of a fluid ejection apparatus according to the first embodiment.
Figure 3:
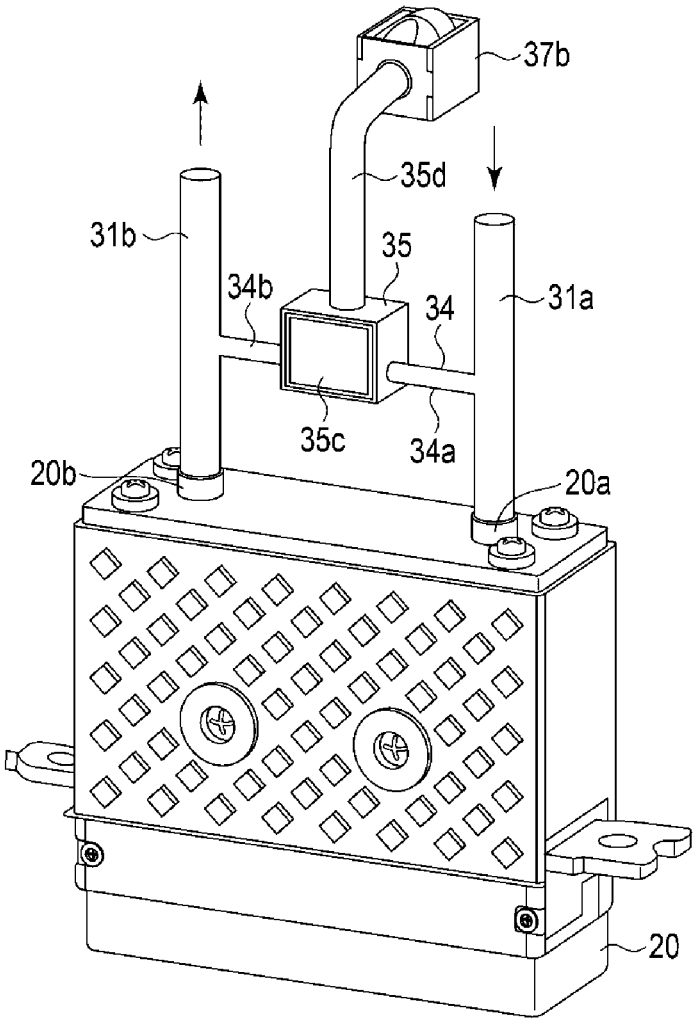
FIG. 3 is a partial perspective view of the fluid ejection apparatus.
Figure 4:
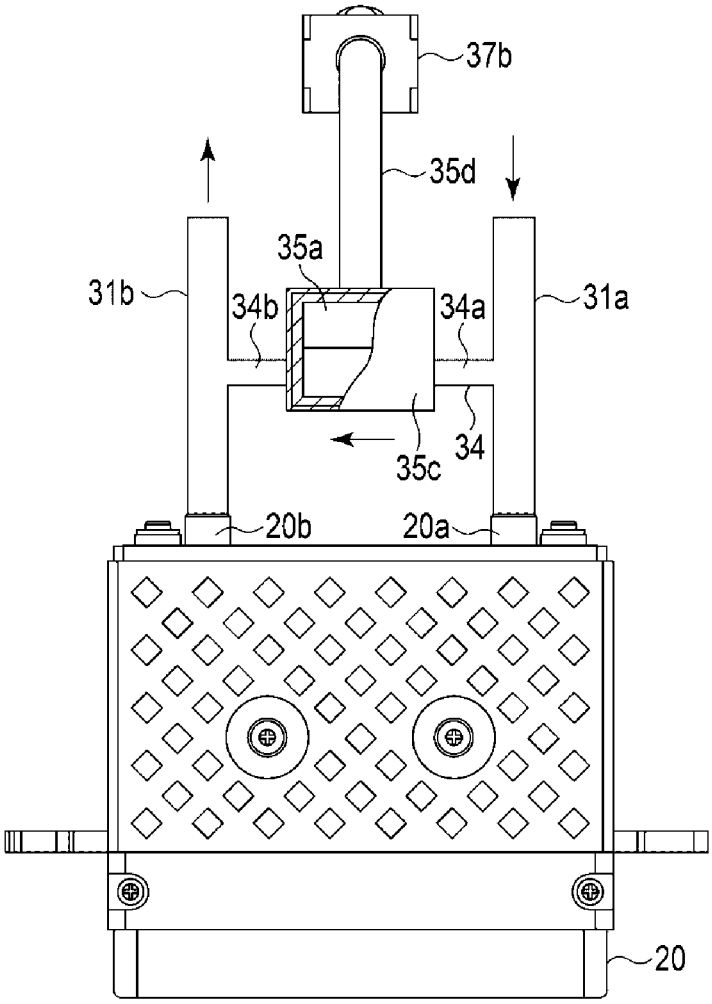
FIG. 4 is a partial front view of the fluid ejection apparatus.
Figure 5:
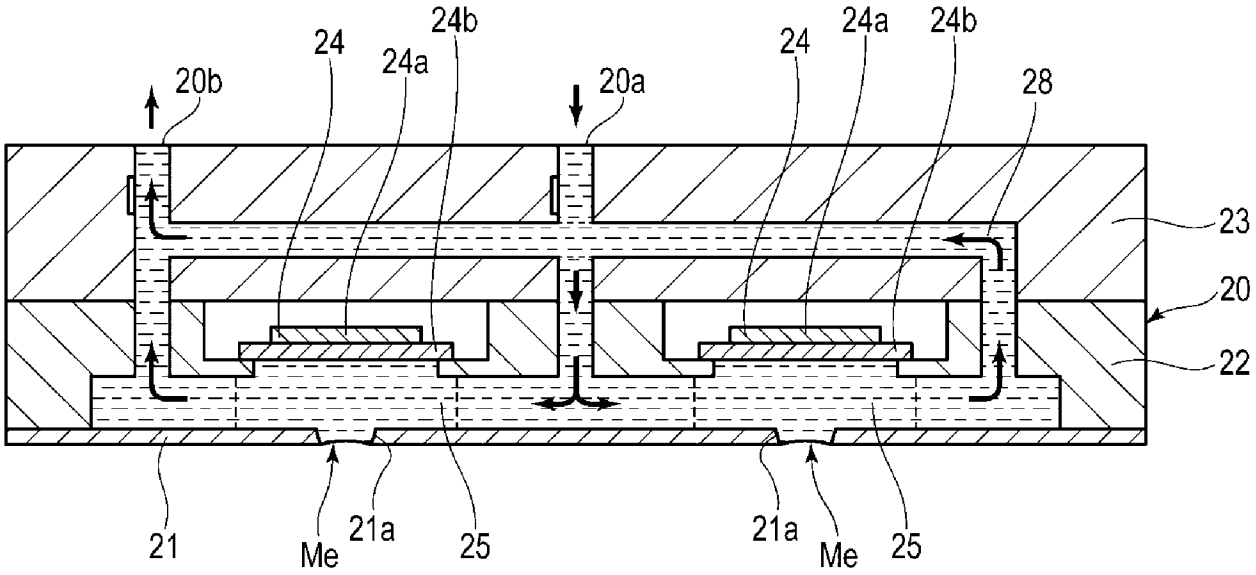
FIG. 5 is an explanatory view of a fluid ejection head of the fluid ejection apparatus.
Figure 6:
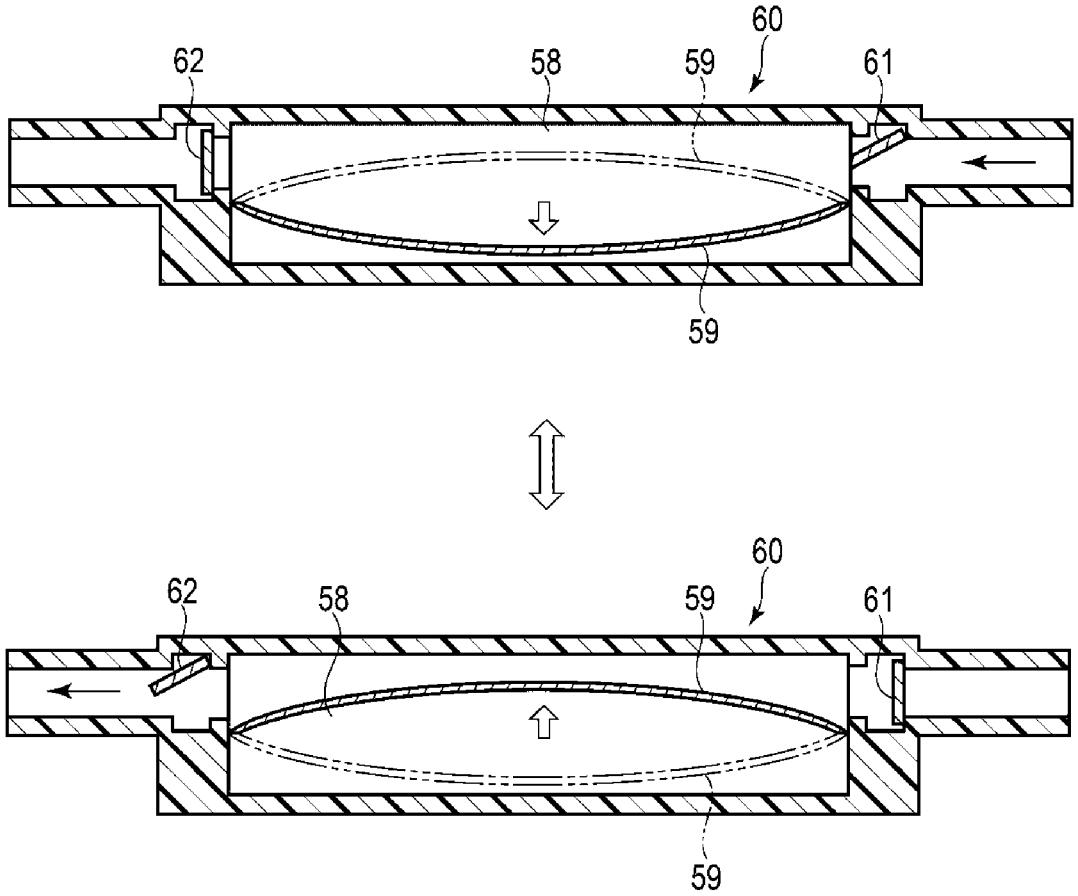
FIG. 6 is an explanatory view of a piezoelectric pump of the fluid ejection apparatus.
Figure 7:
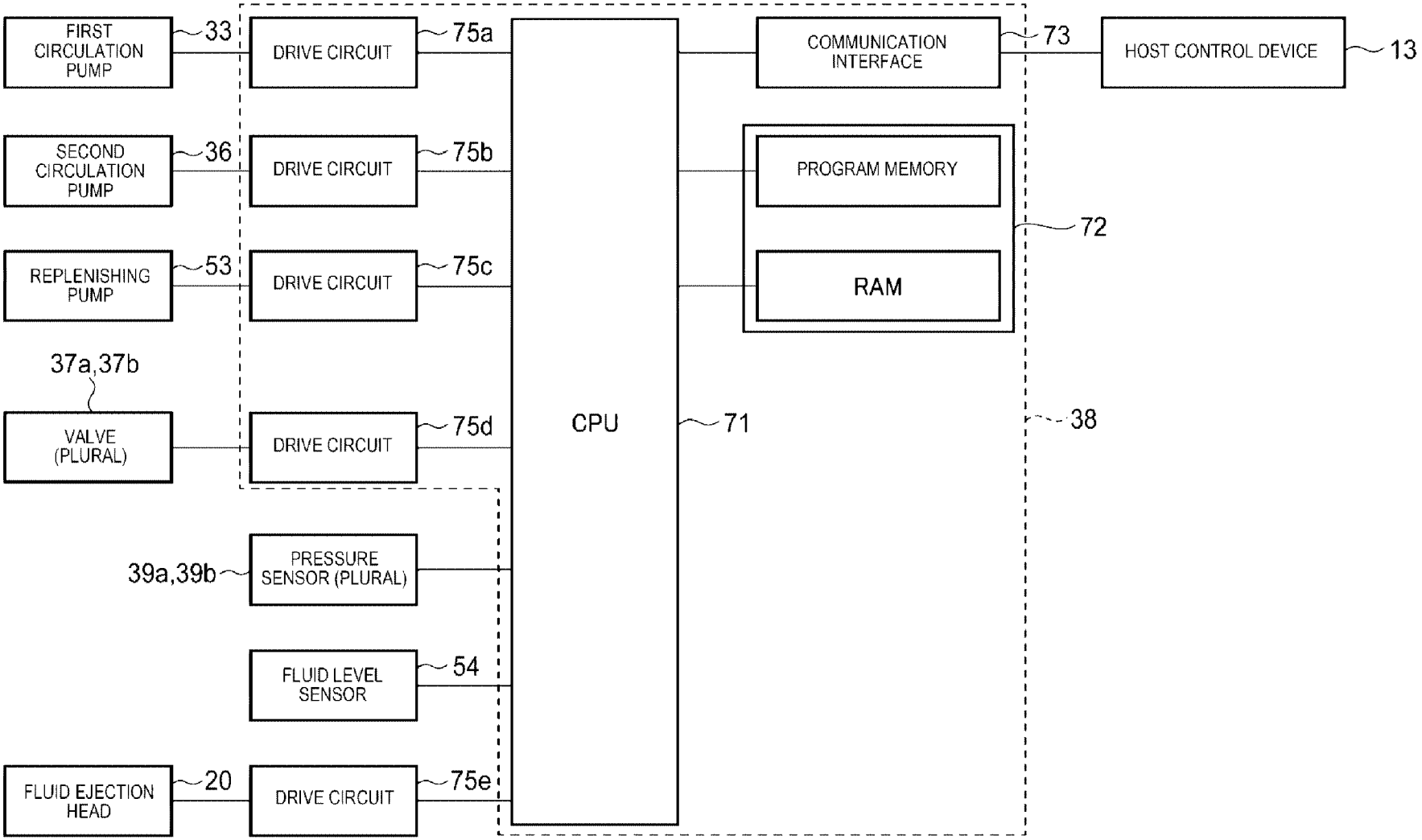
FIG. 7 is a block diagram of a control unit of the fluid ejection apparatus.

Hereinafter, an inkjet recording apparatus 1 and a fluid ejection apparatus 10 according to a first embodiment will be described with reference to FIGS. 1 to 7. It should be noted that the drawings are schematic and are drawn with exaggeration and omissions for purposes of explanatory convenience. In general, components are not drawn to scale. In addition, the number of components, the dimensional ratio between different components, or the like, does not necessarily match between different drawings or to actual devices. FIG. 1 is a side view of the inkjet recording apparatus 1. FIG. 2 is an explanatory view of the fluid ejection apparatus 10. FIGS. 3 and 4 are a partial perspective view and a partial front view of the configuration of the fluid ejection apparatus 10. FIG. 5 is an explanatory view of a fluid ejection head 20. FIG. 6 is an explanatory view of a first circulation pump 33, a second circulation pump 36, and a replenishing pump 53. FIG. 7 is a block diagram of the fluid ejection apparatus 10.

The inkjet recording apparatus 1 shown in FIG. 1 includes a plurality of the fluid ejection apparatuses 10, a head support mechanism 11 for movably supporting the fluid ejection apparatus 10, a medium support mechanism 12 for movably supporting a recording medium S, and a host control device 13.

As shown in FIG. 1, the plurality of fluid ejection apparatuses 10 is arranged in parallel in a predetermined direction and supported by the head support mechanism 11. The fluid ejection apparatus 10 integrally includes a fluid ejection head 20 and a circulation device 30. The fluid ejection apparatus 10 ejects, for example, an ink I from the fluid ejection head 20 as fluid, thereby forming a desired image on the recording mediums S arranged opposite to each other.

The plurality of fluid ejection apparatuses 10 ejects multiple colors such as a cyan ink, a magenta ink, a yellow ink, a black ink, and a white ink, respectively, but the color or characteristic of the ink I to be used is not limited. For example, in place of a white ink, a transparent glossy ink, a specialty ink that develops a color when irradiated with infrared rays or ultraviolet rays, or the like may be ejected. The plurality of fluid ejection apparatuses 10 have the same configuration although fluid to be ejected is different.

The fluid ejection head 20 shown in FIGS. 3 to 5 is an inkjet head and includes a nozzle plate 21 having a plurality of nozzles 21*a*, a substrate 22, and a manifold 23 joined to the substrate 22. The substrate 22 is mounted so as to face the nozzle plate 21 and is configured in a predetermined shape to form a flow path 28 including a plurality of fluid pressure chambers 25 in between the substrate 22 and the nozzle plate 21. An actuator 24 is provided on a portion of the substrate 22 facing each fluid pressure chamber 25. The substrate 22 has partition walls between adjacent fluid pressure chambers 25 in the same row. The actuator 24 is disposed to face the nozzle 21*a*, and the fluid pressure chamber 25 is formed between the actuator 24 and the nozzle 21*a*.

The fluid ejection head 20 includes the flow path 28, with the ink pressure chamber 25 thereon, as formed by the nozzle plate 21, the substrate 22, and the manifold 23. The actuator 24 having electrodes 24*a* and 24*b* is provided at a portion of the substrate 22 facing the fluid pressure chamber 25. The actuator 24 is connected to a drive circuit. In the fluid ejection head 20, the actuator 24 deforms according to applied voltages under the control of a module control unit 38 (depicted in FIG. 2), thereby causing fluid to be ejected from the opposing nozzle 21*a*.

As shown in FIGS. 2 to 4, the circulation device 30 is connected to, or integrated with, the upper part of the fluid ejection head 20 by metal connecting parts. The circulation device 30 includes a circulation path 31 through which fluid circulates through the fluid ejection head 20, an intermediate tank 32 provided in the circulation path 31, the first circulation pump 33, a bypass flow path 34, a buffer tank 35 (as a buffer device 100), the second circulation pump 36, a plurality of opening/closing valves 37*a* and 37*b*, and the module control unit 38 that controls a fluid ejection operation. In general, a buffer tank is a buffer device and may be a discrete component connected to a flow path or may be an integral portion of the flow path formed or shaped to function as a flow buffer within the flow path.

The circulation device 30 includes a cartridge 51, functioning as a supply tank provided outside the circulation path 31, a supply path 52, and the replenishing pump 53. The cartridge 51 is configured to hold the fluid to be supplied to the intermediate tank 32, and the internal air chamber of the cartridge 51 is open to the atmosphere. The supply path 52 is a flow path connecting the intermediate tank 32 and the cartridge 51. The replenishing pump 53 is provided in the supply path 52 and delivers the fluid from the cartridge 51 to the intermediate tank 32.

The circulation path 31 includes a first flow path 31*a* connecting the intermediate tank 32 and a supply port 20*a* (of the fluid ejection head 20) and a second flow path 31*b* connecting a collection port 20*b* (of the fluid ejection head 20) and the intermediate tank 32. The circulation path 31 passes from the intermediate tank 32 through the first flow path 31*a* to the supply port 20*a* and passes from the collection port 20*b* through the second flow path 31*b* to the intermediate tank 32. In the first flow path 31*a*, the first circulation pump 33 is provided. In the second flow path 31*b*, the second circulation pump 36 is provided. The first flow path 31*a* is provided with a first pressure sensor 39*a* (also referred to as a first pressure detector) that detects the fluid pressure in the first flow path 31*a*. The second flow path 31*b* is provided with a second pressure sensor 39*b* (also referred to as a second pressure detector) that detects the fluid pressure in the second flow path 31*b*.

The intermediate tank 32 is connected to the fluid ejection head 20 by the circulation path 31 and is configured to store fluid. The intermediate tank 32 is provided with the opening/closing valve 37*a* configured to open the air chamber of the intermediate tank 32 to the atmosphere. A fluid level sensor 54 is provided to detect the fluid level in the intermediate tank 32.

The bypass flow path 34 is a flow path that connects the downstream side of the first circulation pump 33 on the first flow path 31*a* and the upstream side of the second circulation pump 36 on the second flow path. The bypass flow path 34 connects the primary side of the fluid ejection head 20 and the secondary side of the fluid ejection head 20 in the circulation path 31 in a short circuiting manner (that is, without passing through the fluid ejection head 20). The buffer tank 35 is connected to the bypass flow path 34. That is, the bypass flow path 34 includes a first bypass flow path 34*a* connecting the buffer tank 35 and the first flow path 31*a* and a second bypass flow path 34*b* connecting the buffer tank 35 and the second flow path 31*b*.

For example, the first bypass flow path 34*a* and the second bypass flow path 34*b* may have the same length and the same diameter, both of which have a smaller diameter than the circulation path 31. For example, in the first embodiment, the diameter of the circulation path 31 is set to about 2 to 5 times the diameter of the first bypass flow path 34*a* or the second bypass flow path 34*b*. As an example, the flow path diameter φ1 of the bypass flow path 34 is set to 0.7 mm or less, and the flow path diameter φ2 of the circulation path 31 is set to about 2.0 mm. The first bypass flow path 34*a* and the second bypass flow path 34*b* are each configured to have a length L1 of about 2 mm.

In the first embodiment, the buffer tank 35 is provided at a midpoint of the bypass flow path 34. In the circulation path 31, the distance from a branch point at which the bypass flow path 34 branches from the first flow path 31*a* to the supply port 20*a* is the same as the distance from the collection port 20*b* to the junction point of the second bypass flow path 34*b*.

The buffer tank 35 has a flow path cross-sectional area larger than the flow path cross-sectional area of the bypass flow path 34 and is configured to store fluid. The buffer tank 35 has, for example, an upper wall, a lower wall, a rear wall, a front wall, and a pair of right and left side walls and is configured to have a rectangular box shape forming an accommodating chamber 35*a* for storing fluid therein. The bypass flow path 34 is connected to predetermined portions of the lower portion of the pair of side walls of the buffer tank 35, respectively. In the first embodiment, for example, the connection position of the first bypass flow path 34*a* on the inflow side to the buffer tank 35 and the connection position of the second bypass flow path 34*b* on the outflow side to the buffer tank 35 are set to the same height.

The buffer tank 35 has a flow path cross-sectional area 200 times to 300 times the flow path cross-sectional area of the bypass flow path 34. For example, the buffer tank 35 is configured such that the dimensions in a height direction and a depth direction, which are two directions orthogonal to the bypass flow path 34, are 10 mm, respectively and the dimension in a width direction parallel to the bypass flow path 34 is about 20 mm.

In the buffer tank 35, the fluid flowing through the bypass flow path 34 is disposed in the lower region of the accommodating chamber 35*a*, and an air chamber is formed in the upper region of the accommodating chamber 35*a*. That is, the buffer tank 35 may store a predetermined amount of fluid and air. By this buffer tank 35, the flow path cross-sectional area of the fluid flowing from the bypass flow path 34 is enlarged, whereby the accommodating chamber 35*a* acts as a spring, and fluctuations in the pressure in the circulation path 31 are absorbed.

The buffer tank 35 is configured so that the volume of the accommodating chamber 35*a* is variable. Specifically, a part of the wall forming the accommodating chamber 35*a* (FIG. 4) of the buffer tank 35 is made of an elastically deformable material. Here, the front wall forming the accommodating chamber 35*a* of the buffer tank 35 is composed of a deformable film 35*c* made of, for example, polyimide or PTFE.

The opening/closing valve 37*b* is configured to open the air chamber of the buffer tank 35 to the atmosphere. That is, a connecting pipe 35*d* extending upward is provided on the upper wall of the buffer tank 35, and the opening/closing valve 37*b* that opens and closes the flow path in the connecting pipe 35*d* is provided at the other end of the connecting pipe 35*d*.

The circulation path 31, the bypass flow path 34, and the supply path 52 include a pipe made of a metal or a resin material, and a tube that covers the outer surface of the pipe, for example, a PTFE tube.

The first pressure sensor 39*a* and the second pressure sensor 39*b* output pressure as an electric signal using a semiconductor piezoresistive pressure sensor, for example. The semiconductor piezoresistive pressure sensor includes a diaphragm that receives external pressure and a semiconductor strain gauge formed on the surface of the diaphragm. The semiconductor piezoresistive pressure sensor detects the pressure by converting the change in the electrical resistance caused by the piezoresistive effect generated in the strain gauge as the diaphragm deforms due to the pressure from the outside into an electric signal.

The fluid level sensor 54 is configured to include a float 55 floating on the fluid surface and moving up and down and Hall ICs 56*a* and 56*b* provided at two predetermined positions in the upper and lower portions. The fluid level sensor 54 detects the amount of fluid in the intermediate tank 32 by detecting the float 55 reaching an upper limit position and the lower limit position by the Hall ICs 56*a* and 56*b* to send the detected data to the module control unit 38.

The opening/closing valves 37*a* and 37*b* are provided in the intermediate tank 32 and the buffer tank 35. The opening/closing valves 37*a* and 37*b* are normally closed solenoid opening/closing valves which are opened when power is turned on and closed when the power is turned off. The opening/closing valves 37*a* and 37*b* are opened and closed under the control of the module control unit 38, so that the air chamber of the intermediate tank 32 and the buffer tank 35 may be opened and closed with respect to the atmosphere.

The first circulation pump 33 is provided in the first flow path 31*a* of the circulation path 31. The first circulation pump 33 is disposed between the primary side of the fluid ejection head 20 and the intermediate tank 32 and sends fluid toward the fluid ejection head 20 disposed downstream. The fluid in the first flow path 31*a* is distributed to the fluid flowing in the fluid ejection head 20 and the fluid flowing in the buffer tank 35 through the bypass flow path 34, according to the flow resistance of the flow path through the fluid ejection head 20 and the flow path through the bypass flow path 34. In the first embodiment, the bypass flow path 34 has a smaller diameter than the circulation path 31 so that the flow path resistance on the bypass flow path 34 side is 2 to 5 times the flow path resistance on the fluid ejection head 20 side.

The pressure in the circulation path 31 is such that the primary side of the fluid ejection head 20, that is, the inflow side is at a higher pressure than the secondary side of the fluid ejection head 20, that is, the outflow side due to the pressure loss due to the resistance of the fluid ejection head 20. Therefore, in the circulation path 31 and the bypass flow path 34 passing through the fluid ejection head 20, fluid flows from the high-pressure primary side to the low-pressure secondary side, as indicated by arrows in FIG. 2.

The second circulation pump 36 is provided in the second flow path 31*b* of the circulation path 31. The second circulation pump 36 is disposed between the secondary side of the fluid ejection head 20 and the intermediate tank 32 and sends fluid to the intermediate tank 32 disposed downstream.

The replenishing pump 53 is provided in the supply path 52. The replenishing pump 53 sends the ink I held in the cartridge 51 toward the intermediate tank 32.

The first circulation pump 33, the second circulation pump 36, and the replenishing pump 53 each include a piezoelectric pump 60 as shown in FIG. 6, for example. The piezoelectric pump 60 includes a pump chamber 58, a piezoelectric actuator 59 provided in the pump chamber 58 and vibrating by a voltage, and check valves 61 and 62 disposed at the inlet and outlet of the pump chamber 58. The piezoelectric actuator 59 is configured to vibrate at a frequency of, for example, about 50 Hz to 200 Hz. The first circulation pump 33, the second circulation pump 36, and the replenishing pump 53 are connected to the drive circuit by wiring and are configured to be controllable under the control of the module control unit 38. When an AC voltage is applied to the piezoelectric pump 60 and the piezoelectric actuator 59 is operated, the volume of the pump chamber 58 changes. In the piezoelectric pump 60, when the applied voltage changes, the maximum change amount of the piezoelectric actuator 59 changes, and the volume change amount of the pump chamber 58 changes. Then, when the volume of the pump chamber 58 is deformed in a direction to increase, the check valve 61 at the inlet of the pump chamber 58 is opened and the fluid flows into the pump chamber 58. On the other hand, when the volume of the pump chamber 58 changes in a direction to decrease, the check valve 62 at the outlet of the pump chamber 58 opens and the fluid flows out from the pump chamber 58. The piezoelectric pump 60 repeats expansion and contraction of the pump chamber 58 to deliver the ink I to the downstream. Therefore, when the voltage applied to the piezoelectric actuator 59 is large, fluid delivery capability becomes strong, and when the voltage is small, the fluid delivery capability becomes weak. For example, in the first embodiment, the voltage applied to the piezoelectric actuator 59 is varied between 50 V and 150 V.

As shown in FIG. 7, the module control unit 38 includes a CPU 71, drive circuits 75*a* to 75*e* for driving each element, a storage unit 72 that stores various kinds of data, and a communication interface 73 for communication with an externally provided host control device (host computer) 13 on a control board integrally mounted on the circulation device 30.

The module control unit 38 communicates with the host control device 13 in a state of being connected to the host control device 13 through the communication interface 73, thereby receiving various information such as operation conditions and like.

An input operation by the user and an instruction from the host control device 13 of the inkjet recording apparatus 1 are transmitted to the CPU 71 of the module control unit 38 by the communication interface 73. Various information acquired by the module control unit 38 is sent to the host control device 13 of the inkjet recording apparatus 1 via the communication interface 73.

The CPU 71 corresponds to the central part of the module control unit 38. The CPU 71 controls each unit to realize various functions of the fluid ejection apparatus 10 according to the operating system and the application program.

The various pumps 33, 36, and 53 of the circulation device 30, the drive circuits 75*a*, 75*b*, 75*c*, 75*d* of the opening/closing valves 37*a* and 37*b*, the various sensors 39*a*, 39*b*, 54, and the drive circuit 75*e* of the fluid ejection head 20 are connected to the CPU 71.

For example, the CPU 71 has a function as circulation means for circulating the fluid by controlling the operations of the first and second circulation pumps 33 and 36.

The CPU 71 has a function as replenishing means for replenishing fluid from the cartridge 51 to the circulation path 31 by controlling the operation of the replenishing pump 53 based on the information detected by the fluid level sensor 54 and the pressure sensors 39*a* and 39*b*.

The CPU 71 has a function as a pressure adjustment unit for adjusting the fluid pressure of the nozzle 21*a* by controlling the fluid delivery capability of the first circulation pump 33 and the second circulation pump 36 based on the information detected by the first pressure sensor 39*a*, the second pressure sensor 39*b*, and the fluid level sensor 54.

The CPU 71 functions as fluid level adjusting means for adjusting the fluid level of the intermediate tank 32 and the buffer tank 35 by controlling the opening/closing of the opening/closing valves 37*a* and 37*b*.

The storage unit 72 includes, for example, a program memory and a RAM. The storage unit 72 stores an application program and various setting values. In the storage unit 72, various setting values such as a calculation formula for calculating the fluid pressure of the nozzle 21*a*, a target pressure range, an adjustment maximum value of each pump, and the like are stored as control data used for pressure control, for example.

Figure 8:
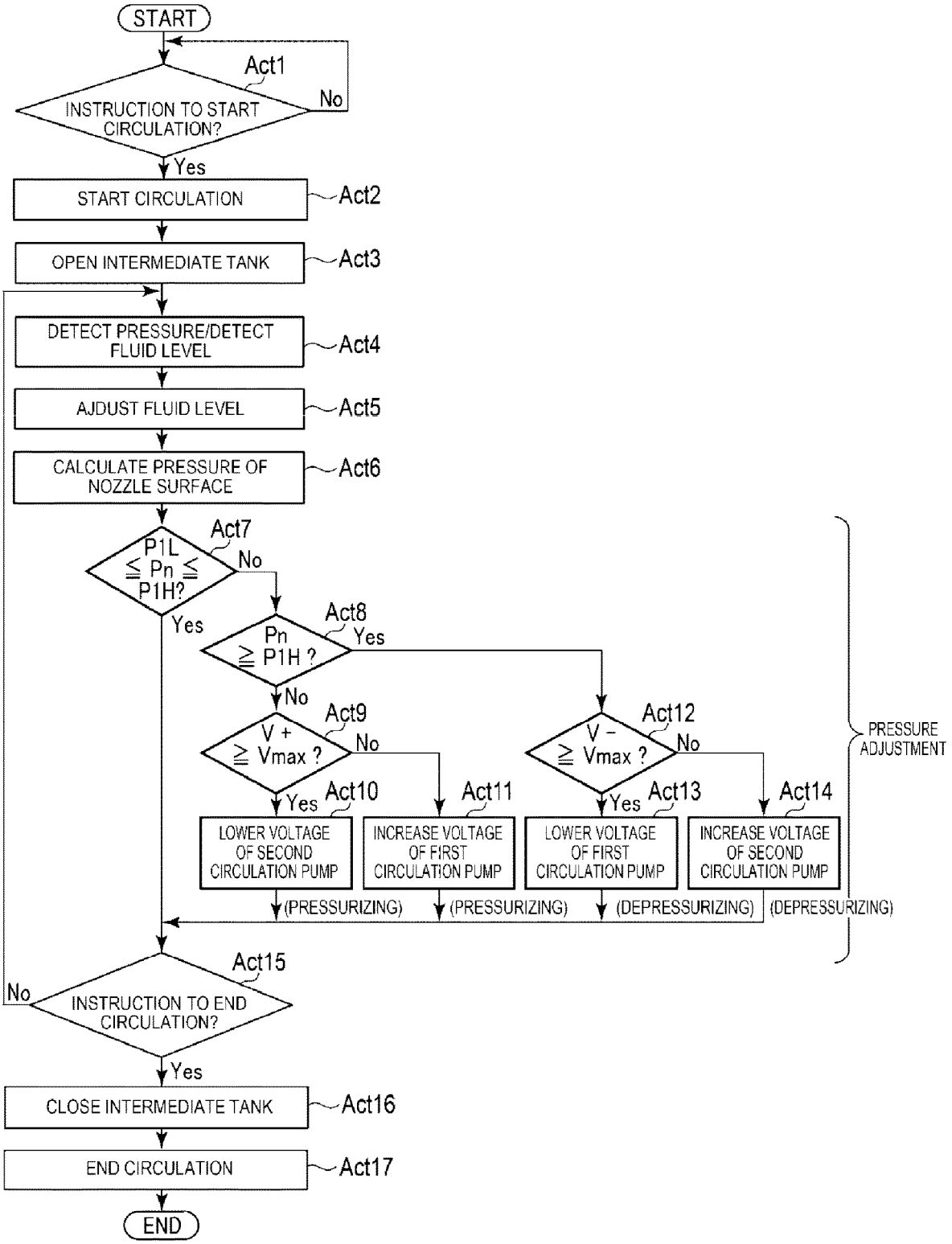
FIG. 8 is a flowchart showing a control method of the fluid ejection apparatus.

Hereinafter, a control method of the fluid ejection apparatus 10 according to the first embodiment will be described with reference to the flowchart of FIG. 8.

In Act 1, the CPU waits for an instruction to start circulation. For example, when an instruction to start circulation is detected with a command from the host control device 13 (Yes in Act 1), the processing proceeds to Act 2. As a printing operation, the host control device 13 forms an image on the recording medium. S by performing a fluid ejecting operation while reciprocally moving the fluid ejection apparatus 10 in a direction orthogonal to the carrying direction of the recording medium S. Specifically, the CPU 71 carries a carriage 11*a* (FIG. 1) provided in the head support mechanism 11 in the direction of the recording medium S to reciprocally move in the direction of an arrow A. The CPU 71 sends the image signal corresponding to the image data to the drive circuit 75*e* of the fluid ejection head 20, selectively drives the actuator 24 of the fluid ejection head 20, and ejects droplets of fluid from the nozzle 21*a* to the recording medium S.

In Act 2, the CPU 71 drives the first circulation pump 33 and the second circulation pump 36 to start a fluid circulation operation. Here, the ink I in the first flow path 31*a* is distributed to the fluid flowing in the fluid ejection head 20 and the fluid flowing in the buffer tank 35 through the bypass flow path 34, according to the flow resistance of the flow path through the fluid ejection head 20 and the flow path through the bypass flow path 34. That is, a part of the ink I flows from the intermediate tank 32 to the fluid ejection head 20 through the first flow path 31*a*, passes through the second flow path 31*b*, and flows into the intermediate tank 32 again. The remaining part of the ink I passes through the bypass flow path 34 and the buffer tank 35 from the first flow path 31*a*, is sent to the second flow path 31*b* without passing through the fluid ejection head 20, and flows into the intermediate tank 32 again. By this circulation operation, the impurities contained in the ink I are removed by the filter provided in the circulation path 31.

In Act 3, the CPU 71 opens the opening/closing valve 37*a* of the intermediate tank 32 and opens the intermediate tank 32 to the atmosphere. Since the intermediate tank 32 is open to the atmosphere and constantly has a constant pressure, pressure drop in the circulation path due to fluid consumption of the fluid ejection head 20 is prevented. Here, when the opening/closing valve 37*a* is opened for a long time to an extent that there is concern about temperature rise of the opening/closing valve 37*a*, the opening/closing valve 37*a* may be opened periodically for a short time. Even if the opening/closing valve 37*a* is closed, it is possible to keep the fluid pressure of the nozzle constant unless the circulation path is excessively reduced in pressure. The solenoid type opening/closing valve 37*a* is normally closed. Therefore, even if the power supply to the apparatus suddenly stops due to a power failure or the like, the opening/closing valve 37*a* may shut off the intermediate tank 32 from the atmospheric pressure by being closed instantaneously and seal the circulation path 31. Therefore, it is possible to suppress leakage of the ink I from the nozzle 21*a* of the fluid ejection head 20.

At the timing instructed by the host control device 13, the CPU 71 opens the opening/closing valve 37*b* of the buffer tank 35 and opens the buffer tank 35 to the atmosphere. Since the buffer tank 35 is opened to the atmosphere and has atmospheric pressure, the fluid level of the buffer tank 35 is lowered.

In this fluid circulation operation, the pressure fluctuation accompanying the ejection operation of the fluid or the like is absorbed by the volume change of the buffer tank 35 and the spring action of the air of the accommodating chamber 35*a*, and the pressure variation is alleviated.

In Act 4, the CPU 71 detects the pressure data transmitted from the first pressure sensor 39*a*. The CPU 71 detects the fluid level of the intermediate tank 32 based on the data transmitted from the fluid level sensor 54.

In Act 5, the CPU 71 starts fluid level adjustment. Specifically, the CPU 71 drives the replenishing pump 53 based on the detection results of the fluid level sensor 54, thereby performing fluid replenishment from the cartridge 51 and adjusting the fluid level position to an appropriate range. For example, at the time of printing, the ink I is ejected from the nozzle 21*a*, the fluid amount of the intermediate tank 32 instantaneously decreases, and when the fluid level is lowered, the fluid is replenished. When the fluid amount increases again and the output of the fluid level sensor 54 is inverted, the CPU 71 stops the replenishing pump 53.

In Act 6, the CPU 71 detects the fluid pressure of the nozzle from the pressure data. Specifically, the fluid pressure of the nozzle 21*a* is calculated by using a predetermined arithmetic expression based on the pressure data on the upstream side and the downstream side transmitted from the first and second pressure sensors 39*a* and 39*b*.

For example, it is possible to obtain a fluid pressure Pn of the nozzle by adding a pressure $\mu gh$ generated by the water head difference between the height of the pressure measurement point and the head height of the nozzle surface height to the average value of a fluid pressure value Ph of the first flow path 31*a* and a fluid pressure value P1 of the second flow path 31*b*. Here, it is assumed that $\rho$ is a density of the fluid, g is gravitational acceleration, and h is a distance between the pressure measurement point and the height direction of the nozzle surface.

As the pressure adjustment processing, the CPU 71 calculates a drive voltage based on the fluid pressure Pn of the nozzle calculated from the pressure data. Then, the CPU 71 maintains a negative pressure to an extent that the ink I does not leak from the nozzle 21*a* of the fluid ejection head 20 and bubbles are not sucked from the nozzle 21*a* and maintains a meniscus Me (FIG. 5) by driving the first circulation pump 33 and the second circulation pump 36 so that the fluid pressure Pn of the nozzle becomes an appropriate value. Here, as an example, it is assumed that the upper limit of a target value is P1H and the lower limit is P1L.

In Act 7, the CPU 71 determines whether the fluid pressure Pn of the nozzle 21*a* is within an appropriate range, that is, whether $P1L \leq Pn \leq P1H$. If Pn is out of the appropriate range (No in Act 7), the CPU 71 determines whether or not the fluid pressure Pn of the nozzle 21*a* exceeds the upper limit of the target value P1H as Act 8.

The fluid pressure at the nozzle 21*a* of the fluid ejection head 20 is pressurized when the driving of the first circulation pump 33 is relatively strong, and is depressurized when the driving of the second circulation pump 36 is relatively strong.

The CPU 71 further determines whether or not the drive voltage is within the adjustment range of the first circulation pump 33 and the second circulation pump 36 (Acts 9 and 12) and pressurizes or depressurizes by using the first circulation pump 33 and the second circulation pump 36 when the drive voltage exceeds an adjustment maximum value Vmax of the first and second circulation pumps 33 and 36.

More specifically, when the fluid pressure Pn of the nozzle 21*a* is out of the appropriate range (No in Act 7) and the fluid pressure Pn of the nozzle 21*a* does not exceed the target value upper limit P1H (No in Act 8), that is, when the fluid pressure Pn of the nozzle is lower than the target lower limit P1L, the CPU 71 determines whether or not a drive voltage V+ of the pressurizing side first circulation pump 33 is equal to or higher than the adjustment maximum value Vmax, that is, whether or not the drive voltage V+ exceeds the adjustable range of the first circulation pump 33 as Act 9. When the drive voltage V+ of the pressurizing side first circulation pump 33 is equal to or higher than the adjustment maximum value Vmax (Yes in Act 9), the CPU 71 pressurizes the voltage by lowering the voltage of the second circulation pump 36 as Act 10. On the other hand, if the drive voltage V+ of the first circulation pump on the pressurizing side is lower than the adjustment maximum value Vmax, and within the adjustable range (No in Act 9), the CPU 71 pressurizes the voltage by increasing the drive voltage of the first circulation pump 33 as Act 11.

In Act 8, when the fluid pressure Pn of the nozzle exceeds the target value upper limit P1H (Yes in Act 8), the CPU 71 determines whether or not a drive voltage V− of the second circulation pump 36 on the depressurizing side is equal to or higher than the adjustment maximum value Vmax, that is, whether or not the drive voltage V− exceeds the adjustment range of the second circulation pump 36 as Act 12. When the drive voltage V− of the second circulation pump 36 on the depressurizing side is equal to or higher than the adjustment maximum value Vmax (Yes in Act 12), the CPU 71 depressurizes the voltage by lowering the voltage of the first circulation pump 33 as Act 13. On the other hand, if the drive voltage V− of the second circulation pump 36 on the depressurizing side is lower than the adjustment maximum value Vmax, and within the adjustable range (No in Act 12), the CPU 71 depressurizes the voltage by decreasing the drive voltage of the second circulation pump 36 as Act 14. That is, the CPU 71 performs pressure adjustment in Acts 7 to 14.

If Pn of the fluid pressure of the nozzle plate 21 is within the appropriate range (Yes in Act 7), the CPU 71 proceeds to Act 15. The CPU 71 performs feedback control of Acts 4 to 14 until a circulation end command is detected in Act 15. Then, when detecting an instruction to end the circulation with a command from the host control device 13 (Yes in Act 15), the CPU 71 closes the opening/closing valve 37*a* of the intermediate tank 32 and seals the intermediate tank 32 (Act 16). The CPU stops the first circulation pump 33 and the second circulation pump 36 and ends the circulation processing (Act 17).

The fluid ejection apparatus 10 configured as described above may stabilize the ejection performance of the fluid ejection head 20 by connecting the flow paths on the upstream side and the downstream side of the fluid ejection head 20 with the bypass flow path 34 and providing the buffer tank 35. That is, by connecting the flow paths on the upstream side and the downstream side of the fluid ejection head 20 with the bypass flow path 34 and disposing the buffer tank 35 and the fluid ejection head 20 in parallel, due to the change in the flow path cross-sectional area between the bypass flow path 34 and the buffer tank 35 and the action of an air layer in the buffer tank 35 as an air spring, the pressure fluctuation in the bypass flow path 34 is absorbed and the pulsation is absorbed, thereby stabilizing the ejection performance.

For example, when the circulation path 31 becomes negative pressure due to a large amount of fluid ejection, the volume of the buffer tank 35 is reduced and the fluid level of the buffer tank 35 is lowered so that the pressure fluctuation on the circulation path 31 side may be absorbed.

The bypass flow path 34 is configured to flow fluid without passing through the fluid ejection head 20. Therefore, for example, if the pressure of the bypass flow path 34 is greatly decreased, the fluid level in the buffer tank 35 is lowered. Even if air bubbles are mixed, since the bubbles in the buffer tank 35 are sent to the intermediate tank 32 through the second bypass flow path 34*b* on the downstream side without passing through the fluid ejection head 20, the air bubbles may be removed and the ejection performance is not affected.

The fluid ejection apparatus 10 may stabilize the fluid level of the buffer tank 35 at all times because the buffer tank 35 is configured to be openable to the atmosphere. In the fluid ejection apparatus 10, a part of the buffer tank 35 is made of a material which may be elastically deformable, and the volume is variable, thereby ensuring the absorption amount of the pressure fluctuation.

The fluid ejection apparatus 10 appropriately sets the pipe resistance of the bypass flow path 34, thereby appropriately maintaining the flow rate of the fluid passing through the fluid ejection head 20 and the fluid flowing through the bypass flow path 34.

The fluid ejection apparatus 10 may maintain the fluid pressure of the nozzle properly by detecting the pressure on both the upstream side and the downstream side of the fluid ejection head 20 and performing feedback control of the pressure with the first circulation pump 33 and the second circulation pump 36 that pressurize. Therefore, even when the pump performance changes over time, it is possible to realize appropriate pressure control.

In the fluid ejection apparatus 10, since the piezoelectric pump 60 is used as the first circulation pumps 33 and 36, the configuration is simple and material selection is easy. That is, the piezoelectric pump 60 does not require a large drive source such as a motor, a solenoid, and the like and may be made smaller than a general diaphragm pump, a piston pump, and a tube pump. For example, if a tube pump is used, there is a possibility that the tube and the fluid come into contact with each other, and therefore it is necessary to select a material that does not cause deterioration of the tube or fluid. On the other hand, it is easy to select a material by using piezoelectric pump 60. For example, in the first embodiment, the fluid contact parts of the piezoelectric pump 60 may be made of SUS 316 L, PPS, PPA, and polyimide which are excellent in chemical resistance.

In the first embodiment, by using the first circulation pump 33 on the upstream side which may be pressurized when the voltage is increased and depressurized when the voltage is lowered, and the second circulation pump 36 on the downstream side which may be depressurized when the voltage is increased and pressurized when the voltage is lowered, when the drive voltage exceeds the adjustable range, another pump may be used, thereby realizing highly accurate control. The functions required for controlling the first circulation pump 33, the second circulation pump 36, the replenishing pump 53, the first and second pressure sensors 39*a*, 39*b*, the fluid level sensor 54, the control board 70, and other fluid supply, circulation, and pressure adjustment are concentrated in the circulation device 30. Therefore, as compared with a large-sized stationary type circulation device, it is possible to simplify the connection and the electrical connection between the main body of the inkjet recording apparatus 1 and the carriage 11*a*. As a result, the inkjet recording apparatus 1 may be reduced in size, weight, and cost.

Second Embodiment

Figure 9:
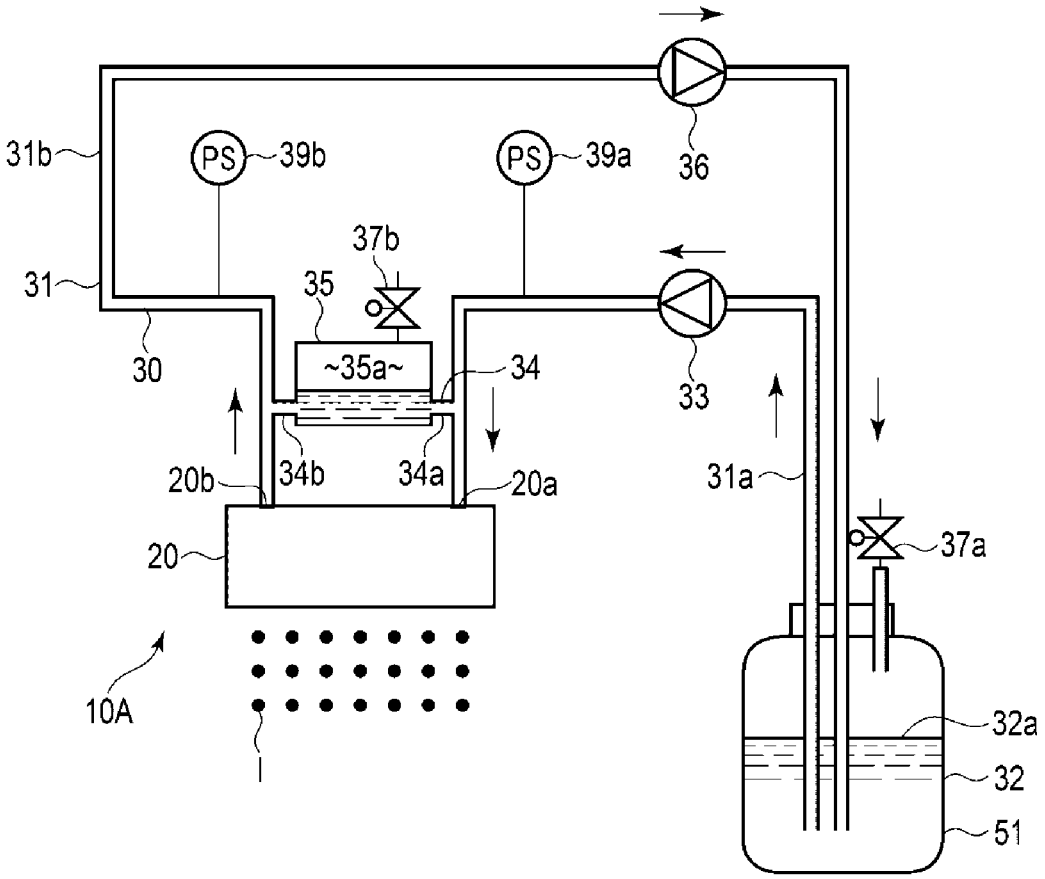
FIG. 9 is an explanatory view of a fluid ejection apparatus according to another embodiment.

Hereinafter, a fluid ejection apparatus 10A according to a second embodiment will be described with reference to FIG. 9. FIG. 9 is an explanatory view of the fluid ejection apparatus 10A. The fluid ejection apparatus 10A according to the second embodiment is the same as the fluid ejection apparatus 10 according to the first embodiment except that the cartridge 51 is used as the intermediate tank 32. The same reference numerals are used for the components that are substantially the same as those of the first embodiment, and the description of repeated components may be omitted.

As shown in FIG. 9, in the fluid ejection apparatus 10A according to the second embodiment, as the intermediate tank 32, the intermediate tank 32 that is openable to the atmosphere is disposed in the circulation path 31 between the first flow path 31*a* and the second flow path 31*b*. That is, the cartridge 51 in the fluid ejection apparatus 10 is used as the intermediate tank 32. The opening/closing valve 37*a* may control opening/closing of the intermediate tank 32 with respect to the atmosphere, or the intermediate tank 32 may be always opened to the atmosphere. In the second embodiment, the same effect as in the first embodiment may be obtained. The cartridge 51 is used as the intermediate tank 32, and the configuration thereof may be omitted. In a fluid circulation apparatus and a fluid ejection apparatus having the above structure, the same effect as in the first embodiment may be obtained.

The configuration of the fluid ejection apparatus according to the example embodiments described above is not limited.

For example, the connection positions to the buffer tank 35 are set to the same height, but a height of the connection positions is not limited thereto. For example, the outflow port of the buffer tank 35 may be disposed above the inflow port. In this case, it is easy to guide the bubbles to the outflow side, and it is possible to promote discharge of bubbles.

Figure 10:
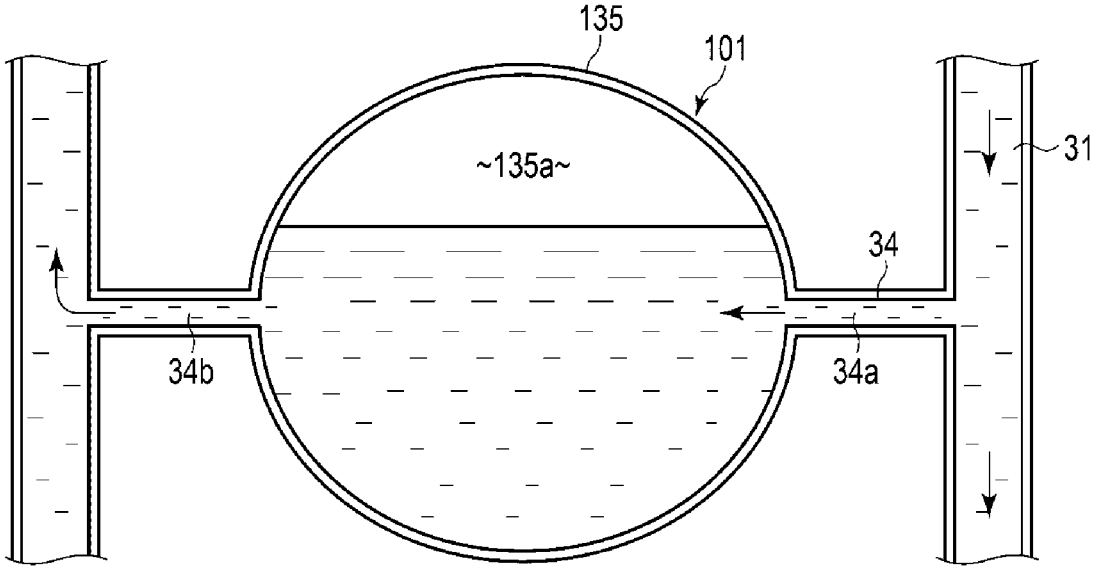
FIG. 10 is an explanatory view showing a configuration of a buffer device of a fluid ejection apparatus according to another embodiment.

The structure of the buffer device is not limited to those in the example embodiments described above. For example, in the example embodiments described above, the buffer tank 35, as a buffer device has a rectangular parallelepiped box. However, in some embodiments, a buffer device 101 depicted in FIG. 10 may include a buffer tank 135 in which the flow path diameter gradually expands and contracts and an inner wall is formed in a curved surface shape. Even in this case, due to the change in the flow path cross-sectional area and the action of the air layer of the accommodating chamber 135*a* as an air spring, it is possible to obtain an effect of stabilizing the ejection performance by absorbing the pressure fluctuation in the bypass flow path 34 and absorbing the pulsation.

Figure 11:
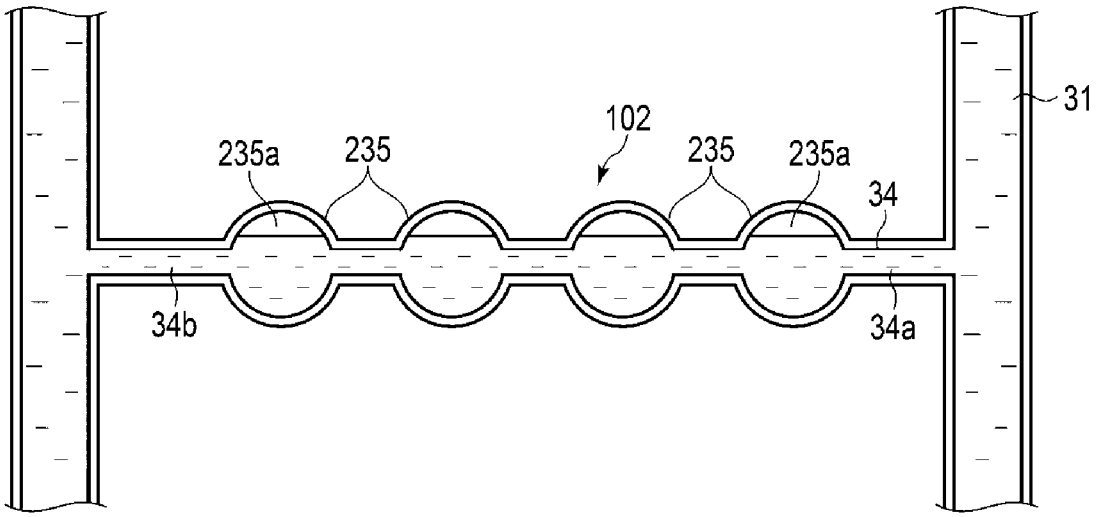
FIG. 11 is an explanatory view of a buffer device of a fluid ejection apparatus according to another embodiment.

In some embodiments, the buffer device 102 depicted in FIG. 11 may include a plurality of buffer tanks 235 having a flow path cross-sectional areas enlarged in the bypass flow path 34. The plurality of buffer tanks 235 is disposed in series in the bypass flow path 34. That is, the bypass flow path 34 changes the cross-sectional area thereof so as to repeatedly expand and contract the flow path cross-sectional area multiple times. Even in this case, due to the change in the flow path cross-sectional area and the action of the air layer of an accommodating chamber 235*a* as an air spring, it is possible to obtain an effect of stabilizing the ejection performance by absorbing the pressure fluctuation in the bypass flow path 34 and absorbing the pulsation.

Figure 12:
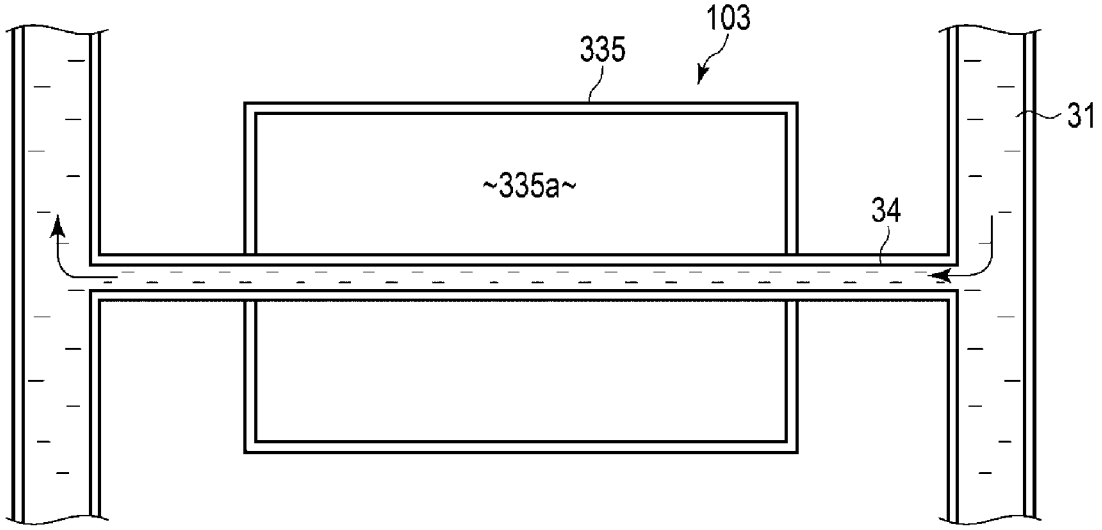
FIG. 12 is an explanatory view showing a configuration of a buffer device of a fluid ejection apparatus according to another embodiment.

In some embodiments, the buffer device 103 depicted in FIG. 12 may be replaced with the buffer tank 35 in which the pipe wall of the bypass flow path 34 is formed of an elastically deformable material such as thin polyimide, thin PTFE or the like, and include a chamber 335 that constitutes an air chamber 335*a* on the outer periphery of the bypass flow path 34. That is, the buffer device 103 surrounds the deformable bypass flow path 34 with the air chamber 335*a*. Even in this case, by forming the pipe wall of the bypass flow path 34 with an elastically deformable material, due to the change in the flow path cross-sectional area and the action of the air layer of the air chamber 335*a* as an air spring, it is possible to obtain an effect of stabilizing the ejection performance by absorbing the pressure fluctuation in the bypass flow path 34 and absorbing the pulsation.

Figure 13:
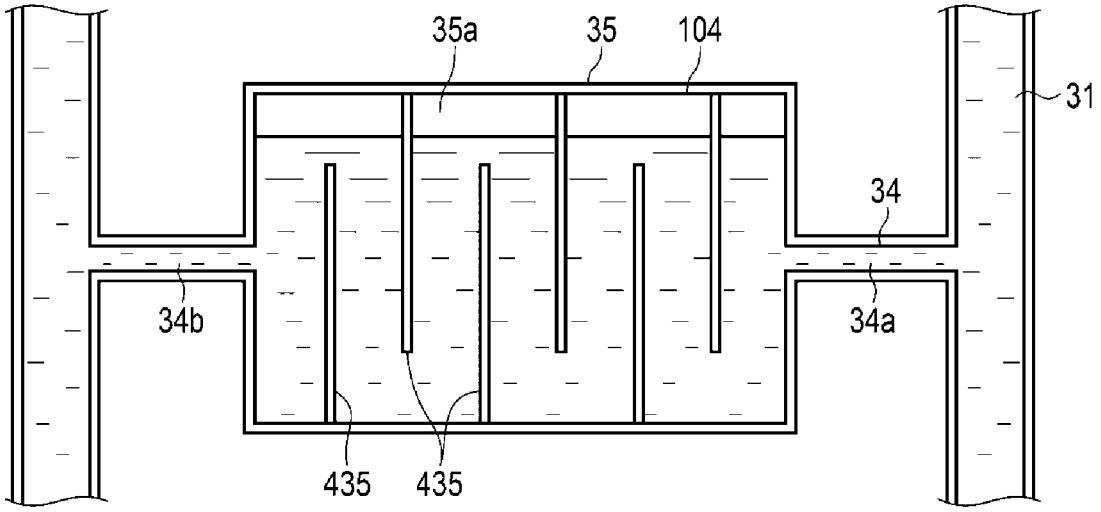
FIG. 13 is an explanatory view of a buffer device of a fluid ejection apparatus according to another embodiment.

It is also possible to add elements such as a distributing plate or an impeller in the buffer tank 35. In some embodiments, the buffer device 104 depicted in FIG. 13 may include a distributing plate inside the buffer tank 35 in which the flow path cross-sectional area is enlarged. Even in this case, due to the change in the flow path cross-sectional area of the bypass flow path 34 and the action of the air layer of an accommodating chamber 35*a* as an air spring, it is possible to obtain an effect of stabilizing the ejection performance by absorbing the pressure fluctuation in the bypass flow path 34 and absorbing the pulsation.

In the example embodiments described above, the flow path diameter of the bypass flow path 34 is smaller than the flow path diameter of the circulation path 31 which is the mainstream and the flow path resistance on the bypass flow path 34 side is increased. However, the flow path diameter of the bypass flow path 34 is not limited thereto. For example, when the flow rate may be secured, it is also possible to reduce the flow resistance on the bypass flow path 34 side by making the diameter of the bypass flow path 34 larger than the diameter of the circulation path 31.

Here, the operation principle will be described. In FIG. 2, the pressure of the supply port 20*a* of the first bypass flow path 34*a* and the fluid ejection head 20 is the same. The pressure of the collection port 20*b* of the second bypass flow path 34*b* and the fluid ejection head 20 is the same. If the diameter of the bypass flow path 34 is made larger than the diameter of the circulation path 31, the amount of fluid flowing into the bypass flow path 34 and the buffer tank 35 is larger than the amount of fluid flowing in the fluid ejection head 20. Then, the pressure of the bypass flow path 34 having a large amount of flowing fluid determines the pressure of the supply port 20*a* of the fluid ejection head 20 and the pressure of the collection port 20*b* of the fluid ejection head 20 more predominantly. Therefore, the pressure of the fluid ejection head 20 will be influenced more by the pressure of the bypass flow path 34. The pressure fluctuation is absorbed by the change in the flow path cross-sectional area between the bypass flow path 34 and the buffer tank 35 and the action of the air layer in the buffer tank 35 as an air spring and is influenced more by the pressure of the bypass flow path 34 whose pulsation is absorbed, whereby the pulsation of the fluid ejection head 20 may be reduced, and the ejection performance is stabilized.

The fluid ejection apparatuses 10 and 10A may also eject fluid other than ink. As a fluid ejection apparatus that ejects fluid other than ink, for example, an apparatus that ejects fluid containing conductive particles for forming a wiring pattern of a printed wiring board, or the like may be used.

In some embodiments, the fluid ejection head 20 may have a structure in which droplets of fluid are ejected by deforming the diaphragm with static electricity, a structure in which droplets of fluid are ejected from a nozzle using thermal energy of a heater, or the like.

In the example embodiments described above, the fluid ejection apparatus is used for the inkjet recording apparatus 1. However, the use of the fluid apparatus is not limited to this example. The fluid ejection apparatus may also be used, for example, in 3D printers, industrial manufacturing machines, and medical applications and may be reduced in size, weight, and cost.

As the first circulation pump 33, the second circulation pump 36, and the replenishing pump 53, for example, a tube pump, a diaphragm pump, a piston pump or the like may be used instead of the piezoelectric pump 60.

In the example embodiments described above, the circulation pumps 33 and 36 are provided on the upstream side and the downstream side, respectively. However, a single circulation pump may be used. Even in this case, it is possible to perform the same function as in the above embodiment by adjusting the positive and negative pressure states of the circulation path by pushing and pulling the fluid.

In the example embodiments described above, the first pressure sensor 39*a* that detects the fluid pressure in the first flow path 31*a* is provided in the first flow path 31*a* and the second pressure sensor 39*b* that detects the fluid pressure in the second flow path 31*b* is provided in the second flow path 31*b*. However, a single pressure sensor may be used in these examples.

While certain embodiments have been described, these embodiments have been presented by way of example only, and are not intended to limit the scope of the present disclosure. Indeed, the novel embodiments described herein may be embodied in a variety of other forms. Furthermore, various omissions, substitutions and changes in the form of the embodiments described herein may be made without departing from the spirit of the disclosure. The accompanying claims and their equivalents are intended to cover such forms or modifications as would fall within the scope and spirit of the present disclosure.

What is claimed is:

1. A fluid circulation apparatus, comprising:

a first tank to store fluid to be supplied to a fluid ejection head;

a circulation path including a first flow path portion to provide fluid from the first tank to a supply port of the fluid ejection head, and a second flow path portion to return fluid from a collection port of the fluid ejection head to the first tank;

a bypass flow path that connects the supply port to the collection port outside of the fluid ejection head;

a buffer tank in the bypass flow path; and an opening/closing valve connected to an air chamber of the buffer tank and configured to selectively open the air chamber to the atmosphere.

2. The fluid circulation apparatus according to claim 1, wherein the buffer tank has a flow path cross-sectional area that is larger than a flow path cross-sectional area of the bypass flow path between the buffer tank and at least one of the supply port and the collection port.

3. The fluid circulation apparatus according to claim 2, wherein the buffer tank has a deformable outer wall.

4. The fluid circulation apparatus according to claim 1, further comprising:

a first pump in the circulation path between the supply port and the first tank, the first pump being configured to send the fluid from the first tank toward the fluid ejection head;

a second pump in the circulation path between the collection port and the first tank, the second pump being configured to send fluid from the fluid ejection head toward the first tank;

a pressure sensor configured to detect pressure of the circulation path; and a processor configured to adjust fluid output rates of the first pump and the second pump based on the pressure of the circulation path.

5. The fluid circulation apparatus according to claim 1, further comprising:

a first pump in the circulation path between the supply port and the first tank, the first pump being configured to send the fluid from the first tank toward the fluid ejection head;

a second pump in the circulation path between the collection port and the first tank, the second pump being configured to send fluid from the fluid ejection head toward the first tank;

a pressure sensor configured to detect pressure of the bypass flow path; and a processor configured to adjust fluid output rates of the first pump and the second pump based on the pressure of the bypass flow path as detected by the pressure sensor.

6. The fluid circulation apparatus according to claim 1, wherein the bypass flow path comprises a first bypass flow path portion fluidly connecting the first flow path portion to the buffer tank and a second bypass flow path portion fluidly connecting the buffer tank to the second flow path portion, and the first bypass flow path portion and the second bypass flow path portion are identical to each other in length and a flow path cross-sectional area that is less than a flow path cross-sectional area of the circulation path.

7. A fluid ejection apparatus, comprising:

a fluid ejection head having a nozzle;

a first tank to store fluid to be supplied to the fluid ejection head;

a circulation path including a first flow path portion to provide fluid from the first tank to a supply port of the fluid ejection head, and a second flow path portion to return fluid from a collection port of the fluid ejection head to the first tank;

a bypass flow path that fluidly connects the first flow path portion to second flow path portion;

a buffer tank in the bypass flow path; and an opening/closing valve connected to an air chamber of the buffer tank and configured to selectively open the air chamber to the atmosphere.

8. The fluid ejection apparatus according to claim 7, wherein the buffer tank has a flow path cross-sectional area that is larger than a flow path cross-sectional area of the bypass flow path between the buffer tank and at least one of the supply port and the collection port.

9. The fluid ejection apparatus according to claim 8, wherein the buffer tank has a deformable outer wall.

10. The fluid ejection apparatus according to claim 7, further comprising:

a first pump in the circulation path between the supply port and the first tank, the first pump being configured to send the fluid from the first tank toward the fluid ejection head;

a second pump in the circulation path between the collection port and the first tank, the second pump being configured to send fluid from the fluid ejection head toward the first tank;

a pressure sensor configured to detect pressure of the circulation path; and a processor configured to adjust fluid output rates of the first pump and the second pump based on the pressure of the circulation path.

11. The fluid ejection apparatus according to claim 7, further comprising:

a first pump in the circulation path between the supply port and the first tank, the first pump being configured to send the fluid from the first tank toward the fluid ejection head;

a second pump in the circulation path between the collection port and the first tank, the second pump being configured to send fluid from the fluid ejection head toward the first tank;

a pressure sensor configured to detect pressure of the bypass flow path; and a processor configured to adjust fluid output rates of the first pump and the second pump based on a pressure of the bypass flow path as detected by the pressure sensor.

12. The fluid ejection apparatus according to claim 7, further comprising:

a cartridge outside of the circulation path fluidly connected to the first tank, wherein an air chamber of the cartridge is open to the atmosphere.

13. A fluid ejection apparatus, comprising:

a fluid ejection head having a nozzle;

a cartridge to store fluid to be supplied to the fluid ejection head;

a circulation path including a first flow path portion to provide fluid from the cartridge to a supply port of the fluid ejection head, and a second flow path portion to return fluid from a collection port of the fluid ejection head to the cartridge;

a bypass flow path that fluidly connects the supply port to the collection port outside of the fluid ejection head and the circulation path;

a buffer tank in the bypass flow path; and an opening/closing valve connected to an air chamber of the buffer tank and configured to selectively open the air chamber to the atmosphere.

14. The fluid ejection apparatus according to claim 13, wherein the buffer tank has a flow path cross-sectional area that is larger than a flow path cross-sectional area of the bypass flow path between the buffer tank and at least one of the supply port and the collection port.

15. The fluid ejection apparatus according to claim 14, wherein the buffer tank has a deformable outer wall.

16. The fluid ejection apparatus according to claim 13, further comprising:

a first pump in the circulation path between the supply port and the cartridge, the first pump being configured to send the fluid from the cartridge toward the fluid ejection head;

a second pump in the circulation path between the collection port and the cartridge, the second pump being configured to send fluid from the fluid ejection head toward the cartridge;

a pressure sensor configured to detect pressure of the circulation path; and a processor configured to adjust fluid output rates of the first pump and the second pump based on the pressure of the circulation path as detected by the pressure sensor.

17. The fluid ejection apparatus according to claim 13, further comprising:

a first pump in the circulation path between the supply port and the cartridge, the first pump being configured to send the fluid from the cartridge toward the fluid ejection head;

a second pump in the circulation path between the collection port and the cartridge, the second pump being configured to send fluid from the fluid ejection head toward the cartridge;

a pressure sensor configured to detect pressure of the bypass flow path; and a processor configured to adjust fluid output rates of the first pump and the second pump based on a pressure of the bypass flow path as detected by the pressure sensor.

* * * * *